US010386120B2

(12) United States Patent
Rizzi

(10) Patent No.: US 10,386,120 B2
(45) Date of Patent: Aug. 20, 2019

(54) SHELL AND TUBE HEAT EXCHANGER

(71) Applicant: Casale SA, Lugano (CH)

(72) Inventor: Enrico Rizzi, Casnate con Bernate (IT)

(73) Assignee: Casale SA, Lugano (CH)

( * ) Notice: Subject to any disclaimer, the term of this patent is extended or adjusted under 35 U.S.C. 154(b) by 0 days.

(21) Appl. No.: 15/326,355

(22) PCT Filed: Jun. 19, 2015

(86) PCT No.: PCT/EP2015/063867

§ 371 (c)(1),
(2) Date: Jan. 13, 2017

(87) PCT Pub. No.: WO2016/008675

PCT Pub. Date: Jan. 21, 2016

(65) Prior Publication Data

US 2017/0205147 A1 Jul. 20, 2017

(30) Foreign Application Priority Data

Jul. 16, 2014 (EP) ..... 14177210

(51) Int. Cl.
*F28D 7/00* (2006.01)
*F28F 9/22* (2006.01)
(Continued)

(52) U.S. Cl.
CPC ..... *F28D 7/1607* (2013.01); *F28F 9/001* (2013.01); *F28F 9/0131* (2013.01);
(Continued)

(58) Field of Classification Search
CPC ..... F28D 7/1607; F28D 2021/0059; F28F 9/001; F28F 9/0131; F28F 9/0202; F28F 9/0241; F28F 2009/224; F28F 2009/226
(Continued)

(56) References Cited

U.S. PATENT DOCUMENTS 1,962,362 A 6/1934 Reed
4,298,058 A 11/1981 Wochele
(Continued)

FOREIGN PATENT DOCUMENTS

EP 2 400 247 A2 12/2011

OTHER PUBLICATIONS

International Search Report issued in connection with PCT/EP2015/063867.

(Continued)

*Primary Examiner* — Davis D Hwu
(74) *Attorney, Agent, or Firm* — Akerman LLP

(57) ABSTRACT

Shell and tube heat exchanger (1) comprising a first outer shell (2) and a tube bundle (3), inlet and outlet interfaces communicating with the shell side and with the tube side for a first fluid and for a second fluid respectively, wherein the exchanger comprises a second shell (4) which is inside said first shell (2) and surrounds said tube bundle (3); said second shell (4) comprises at least one releasable longitudinal joint (32) and a plurality of longitudinal sections connected by releasable joints; said second shell (4) delimits the shell side of the exchanger (1) around said tube bundle (3), and further defines a flushing interspace (5) communicating with said shell side, said first fluid flows through said shell side along one or more longitudinal passages, and said first fluid and said second fluid are counter-current along said one or more longitudinal passages.

10 Claims, 5 Drawing Sheets

(51) Int. Cl.

| | |
|---|---|
| ***F28D 7/16*** | (2006.01) |
| ***F28F 9/00*** | (2006.01) |
| ***F28F 9/013*** | (2006.01) |
| ***F28F 9/02*** | (2006.01) |
| *F28D 21/00* | (2006.01) |

(52) U.S. Cl.
CPC ..... *F28F 9/0202* (2013.01); *F28F 9/0241* (2013.01); *F28F 9/0243* (2013.01); *F28D 2021/0059* (2013.01); *F28F 2009/224* (2013.01); *F28F 2009/226* (2013.01)

(58) Field of Classification Search
USPC ..... 165/159
See application file for complete search history.

(56) References Cited

U.S. PATENT DOCUMENTS

| | | | | |
|---|---|---|---|---|
| 4,689,969 | A | 9/1987 | Van Steenburgh, Jr. | |
| 5,871,045 | A | 2/1999 | Hirth et al. | |
| 2004/0226694 | A1* | 11/2004 | Dilley ..... | F28D 7/1607 165/82 |

OTHER PUBLICATIONS

International Preliminary Report on Patentability issued in connection with PCT/EP2015/063867.

* cited by examiner

SHELL AND TUBE HEAT EXCHANGER

This application is a national phase of PCT/EP2015/063867, filed Jun. 19, 2015, and claims priority to EP 14177210.3, filed Jul. 16, 2014, the entire contents of both of which are hereby incorporated by reference.

FIELD OF APPLICATION

The invention relates to shell and tube heat exchangers, in particular for the chemical or petrochemical industry.

PRIOR ART

Shell and tube heat exchangers are widely used in the petrochemical sector. These heat exchangers generally have the task of transferring heat from a high temperature and pressure fluid, for example the effluent gases from a chemical reactor, to another fluid, for example water, in order to recover the heat contained in the gas or in order to generate steam.

The working conditions of these apparatus are often critical for the materials. The hot fluid normally has high temperature and pressure and may also have an aggressive chemical composition. For example, the gas leaving an ammonia synthesis reactor has typically a temperature of about 450° C. and a pressure of about 140 bar; said gas also has high partial pressures of hydrogen (80-85 bar) and nitrogen (about 30 bar). It is known that in these operating conditions the hydrogen and nitrogen attack the surface of the steels, causing weakening and the possible formation of fissures and breakages. Therefore, a heat exchanger intended to operate in these conditions is heavily stressed and requires high-quality steels, for example stainless steels, and very thick walls. This increases the costs considerably.

In order to overcome this drawback, i.e. to limit the construction costs, while operating in completely safe conditions, the prior art teaches keeping the temperature as low as possible, for the same pressure value. It is known that the speed of nitrogen attack on the surface of steel (nitriding effect) increases exponentially for temperatures over 370-380° C., therefore the prior art has attempted to keep the temperature of the parts under pressure below these values, so to use low-alloy steels which are less expensive than stainless steels.

In particular, the problem posed is that of limiting the temperature of the outer shell of the exchanger. To this purpose it is known to use the flushing technique, i.e. causing a cooling current to pass over the inner wall of the shell. However, this technique gives rise to a number of disadvantages which have not been solved yet.

For example, in an exchanger with U-shaped tubes flushing is performed with an inner wall (also named "shroud"). A hot fluid, for example gas coming from a reactor, hits the tube bundle and cools passing longitudinally through the apparatus along its entire length; the partially cooled flow is then conveyed into the space between the shell and the shroud, so as to provide a flushing effect and prevent direct contact between the outer shell and the incoming hot fluid.

This configuration has the significant drawback of not employing a pure counter-current flow. The hot fluid in fact strikes the U-shaped tube bundle with a substantially longitudinal motion, such that only half of the tube bundle operates with a counterflow exchange, and the heat exchange is affected as a result.

In order to overcome this drawback, in the prior art and especially during the recovery of heat from gaseous effluents (for example in ammonia plants) a solution with two exchangers in series is used. The first exchanger, operating at a higher temperature, is flushed using an inner shroud as described above. Said first exchanger is located immediately downstream of the reactor and typically has the shell side which is crossed by the hot fluid and a cooling fluid, for example boiling water, circulates in the tube side. The partially cooled fluid leaving said first exchanger is sent to a second exchanger where it circulates inside the tubes. This way, the second exchanger may operate in a counter-current regime, thus favouring the heat exchange; however, a significant disadvantage is the use of two vessels, with greater costs both for the vessels and the connection piping and foundations. In the case of revamping of existing plants, a further problem of this solution is the limited amount of space available which, in some cases, does not allow the installation of two heat exchangers.

These problems can be better understood with reference to FIG. 9 which shows an example of scheme of a plant according to the prior art.

A flow 101 emerging at high temperature from an ammonia reactor 100 is cooled in a first apparatus 102 and in a second apparatus 103, both comprising a U-shaped tube bundle. In the first apparatus 102 the flow 101 passes longitudinally through the shell side, while a water flow 105 travels along the tube side exiting as steam 106. The first apparatus 102 comprises a wall 107 which surrounds the U-shaped tube bundle; the gas 101, after passing longitudinally through the apparatus, rises up inside the interspace 108, flowing out along the flow line 109. As a result of this conveying action, the gas 101 inside the first apparatus 102 is in a counter-current flow for about half of the tube bundle, while it is substantially in a co-current flow through the remaining portion of said bundle. The gas 109 flowing out of the first apparatus 102 is conveyed to the second apparatus 103 where it circulates inside the tubes, preheating the water 104 circulating in the shell side. The pre-heated water leaving said apparatus 103 forms the flow 105 directed towards the first apparatus.

Other problems which are encountered with the exchangers of the prior art are the following:

In order to obtain several passages in the shell side, if required, longitudinal baffles must be provided, which however introduce problems for the removal or replacement of the tube bundle. Said baffles must also be designed and constructed carefully in order to prevent leakages.

Another problem consists in the bypass areas between the shell and tube bundle, owing to the distance between said two elements. The gas passing through the bypass areas does not come into contact with the tube bundle and does not contribute to the heat exchange, reducing the efficiency.

These problems have not yet been solved, despite an incentive to do so, in particular in chemical plants where it is increasingly attempted to optimize the recovery of heat from gaseous effluents.

SUMMARY OF THE INVENTION

The invention aims to provide a heat exchange apparatus which, compared to the prior art, is able to achieve: a reduction in the temperature of outer shell by means of flushing; a greater thermal efficiency by means of elimination of the bypass zone at the periphery of the tubes; a greater flexibility of configurations as regards the location of the gas inlet and gas outlet for the shell-side; constructional simplicity; lower costs owing to the use of materials of a lower quality or of smaller thickness.

These objects are achieved with a heat exchanger according to claim 1. Some preferred characteristic features are mentioned in the dependent claims.

Advantageously the exchanger comprises a system of baffles which defines a plurality of shell-side passages around the tube bundle and inside said second shell, wherein consecutive passages have opposite directions of through-flow and the first or last of said passages directly communicates with said interspace. For example, in a preferred embodiment with two passages, said system of baffles defines a first shell-side passage and a second shell-side passage, said first passage and second passage have opposite directions of through-flow and said second passage directly communicate with said interspace.

Each shell-side passage is formed in a portion of the exchanger containing a respective subassembly of tubes of the tube bundle and/or respective portions of the said tubes. The tube-side fluid supply means are arranged so that the tube-side flow in each of said portions is always in an opposite direction to the respective shell-side passage.

Said second inner shell, preferably, is structurally integral with the tube bundle. More particularly, in a preferred embodiment the tube bundle comprises a plurality of baffles which are transverse to the tubes, and said inner shell cooperates structurally with said baffles. For example, the shell cooperates structurally with the baffles, resting on said baffles or being integral therewith.

Said second shell, more preferably, comprises a plurality of circumferential and/or longitudinal portions which may be removed. In one embodiment, said shell comprises at least one releasable longitudinal joint. A longitudinal baffle which defines two passages in the shell side may be advantageously housed along a releasable longitudinal joint between two portions of the shell. This characteristic feature is advantageous in particular if the tube bundle is of the U-shaped type.

The inner shell also allows the bypass areas to be reduced, being closer to the tube bundle than the outer shell of the exchanger. In some embodiments, said inner shell has a non-circular cross-section able to remain tight to the edge of the transverse baffles and close to the peripheral tubes of the tube bundle. For example, the shell may have a cross-section of a regular or irregular polygon or a cross-section comprising one or more straight sides or several curvilinear sides.

According to another preferred characteristic feature, the connection between the transverse baffles of the tube bundle and said inner shell is substantially fluid-tight. The term "substantially fluid-tight" means that the connection between baffles and shell is sealed or allows a flow bypass which however is negligible in relation to the total throughput. Said feature allows realizing more easily transverse partitions of the exchanger, for example using blind baffles.

The inner shell, which may be removed and configured according to the requirements, has substantially the following advantages: it defines the interspace for flushing of the outer shell and therefore allows a reduction in the design temperatures and the use of lower-quality and less costly materials; it reduces or eliminates the bypass zones along the periphery of the tubes, with a consequent increase in the thermal efficiency of the apparatus; it allows a channeling of the shell-side flow along paths which are advantageous in terms of efficiency and/or constructional simplicity.

Another advantage of the invention consists in the fact that, owing to the suitable partitions on the shell side, the flow in the shell side is fully counter-current relative to the fluid circulating in the tubes.

A further advantage of the invention is that the heat recovery from the effluent of a reactor, typically an ammonia reactor, may be conveniently performed using only one apparatus rather than two. In addition to savings in the cost of the apparatuses, there are savings in the piping and installation works, since critical high-temperature flow lines are avoided. The compact design is particularly suitable for a possible revamping of the plant, if necessary, since usually the spaces available are very limited. Finally, the reduced number of connections reduces the risk of potentially dangerous leakages.

The advantages will emerge even more clearly with the aid of the detailed description below relating to a number of preferred embodiments.

DETAILED DESCRIPTION

Figure 1:
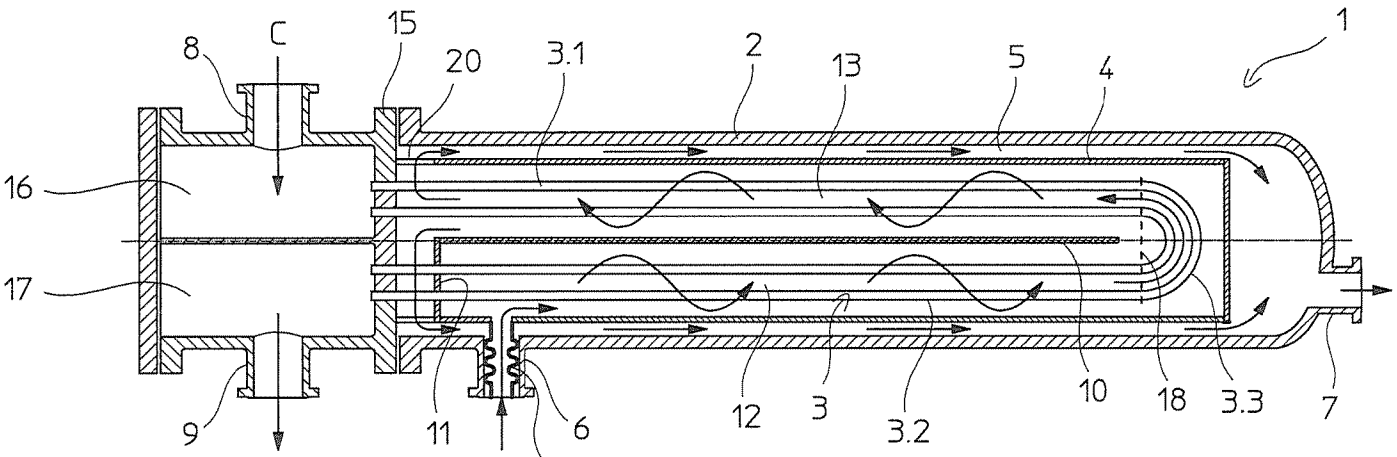
FIGS. 1 to 4 show a diagrammatic cross-section of a shell and tube heat exchanger according to a first, second, third and fourth embodiment of the invention, respectively.

FIG. 1 is a diagrammatic illustration of a heat exchanger apparatus 1 comprising an outer shell 2; a tube bundle 3 inside said outer shell 2; and a second shell 4.

Said second shell 4 surrounds the tube bundle 3 and is internally coaxial with the shell 2. A flushing interspace 5 is thus defined between the two shells 2 and 4.

The tube bundle 3 comprises a plurality of U-shaped tubes fixed to a tube plate 15. Each of tubes 3 comprises a first straight section 3.1, a second straight section 3.2 and a connecting section 3.3.

The exchanger 1 has a shell side and a tube side. The shell side substantially corresponds to the space defined inside the second shell 4, around the tube bundle 3; the tube side corresponds to the inside of the tubes of said tube bundle 3.

The exchanger 1 comprises an inlet interface 6 and outlet interface 7 for a first fluid and an inlet interface 8 and outlet interface 9 for a second fluid. The interfaces 6, 7 communicate with the shell side; the interfaces 8, 9 communicate with the tube side via a supply chamber 16 and a collection chamber 17. The interfaces 6-9 are preferably formed by nozzles.

In the example shown in FIG. 1, a hot fluid H enters via the interface 6 and exits cooled from the interface 7, flowing along the shell side; a colder fluid C enters via the interface 8 and exits heated from the interface 9 flowing along the tube side.

The exchanger 1 also comprises a system of baffles comprising a longitudinal baffle 10 and a transverse baffle 11, which define two passages inside the shell side.

In greater detail, a first passage is defined in a portion 12 of the shell side containing the return branches 3.2 of the tubes; a second passage is defined in a portion 13 of the same shell side containing the outgoing branches 3.1 of the tubes.

The longitudinal baffle 10 extends substantially along the whole length of the tubes of the bundle 3 and is situated in a median plane of the tube bundle 3, thus separating the branches 3.1 and 3.2 of each tube. The baffle 11 is situated in the vicinity of the interface 6 in such a way that a fluid entering via said interface 6 is conveyed into the portion 12 of the shell side, in the direction indicated by the arrows in FIG. 1.

The portion 12 communicates directly with the interface 6. The portion 13 communicates with the interspace 5 via openings 20. Advantageously, both the interface 6 and the openings 20 and the baffle 11 are located in the vicinity of the tube plate 15.

Owing to this arrangement of the baffles 10, 11, the openings 20 and the inlet interface 6, the hot fluid H crosses in sequence said two portions 12 and 13 of the shell side, i.e. following two flow paths in the sense indicated by the arrows, wherein:

along the first flow path, i.e. inside the portion 12, the flow is away from the tube plate 15 and towards the U-shaped connecting zone of the tube bundle;

along the second flow path, i.e. inside the portion 13, the flow is in the opposite direction, i.e. directed towards the tube plate 15.

After flowing along the second portion 13, the fluid H, which is already cooled, passes into the interspace 5 through the openings 20 and reaches the outlet interface 7. In this way, it performs a flushing and cooling action on the shell 2.

The inlet interface 8 and outlet interface 9 for the tube side are arranged so as to define an outgoing flow along the branches 3.1 of the U-shaped tubes located in the portion 13, and a return flow in the opposite direction along the branches 3.2 of the same tubes which are located in the portion 12. Consequently, the hot fluid H in the shell side is always in a counter-current flow relative to the cooling fluid C circulating inside the tubes.

Preferably, the hot fluid H is a gas, for example reaction products collected from a chemical reactor, and the cooling fluid C is water which may be partially or completely evaporated when passing inside the exchanger 1.

The following are some preferred features which are equally applicable both to the example of FIG. 1 and to the other examples shown.

Advantageously, the interface 6 is formed by an inlet nozzle into the shell 2, which is connected to the inner shell 4 by means of a compensator 14.

The tube bundle 3 comprises advantageously a plurality of transverse anti-vibration baffles 18 which are made for example using the rod-baffle construction technique.

The inner shell 4 may be fixed to the tube plate 15 in some embodiments or may be axially fixed (in a direction parallel to the axis of the reactor 1) to one or more of the baffles 18. Preferably, said shell 4 is fixed axially to a baffle 18 situated on the opposite side to the plate 15, i.e. in the vicinity of the U-shaped connecting section of the tubes.

Figure 6:
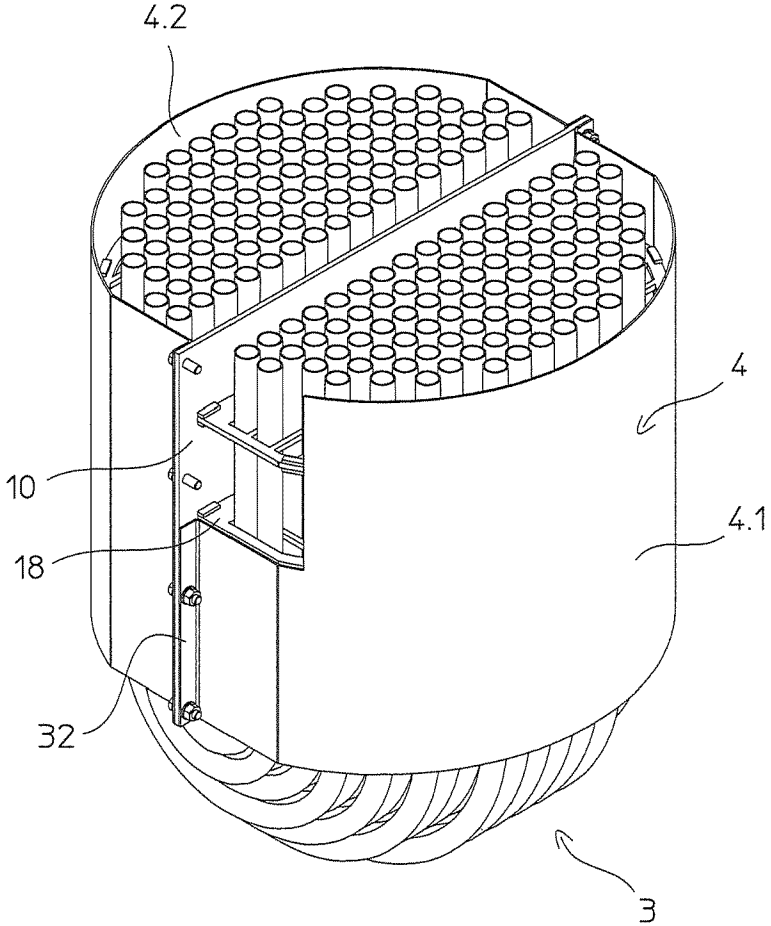
FIG. 6 is a perspective view of a portion of a tube bundle with U-shaped tubes having a cylindrical shell provided with a longitudinal joint according to a preferred characteristic feature of the invention.
Figure 5:
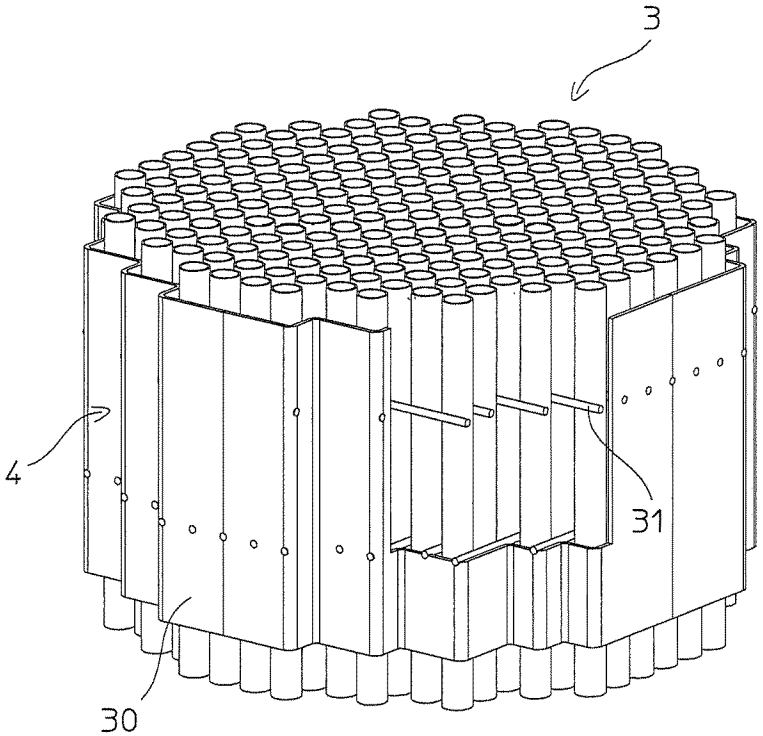
FIG. 5 is a perspective view of a portion of a tube bundle with a polygonal section shell fixed to the baffles of the tube bundle according to one of various modes of implementing the invention.

For simplicity, only one baffle 18 is shown in FIG. 1 and in the other figures; advantageously the exchanger comprises a plurality of baffles 18 which are spaced by a suitable pitch. Examples of embodiment of said baffles 18 are shown in FIGS. 5 and 6.

Generally speaking, said inner shell 4 requires at least one fixed point of restraint. In some embodiments, said fixed point of restraint is realized in the vicinity of the inlet interface 6, thus avoiding the need for the compensator 14 if difference of the radial expansion between the shells 2 and 4 is negligible.

Figure 2:
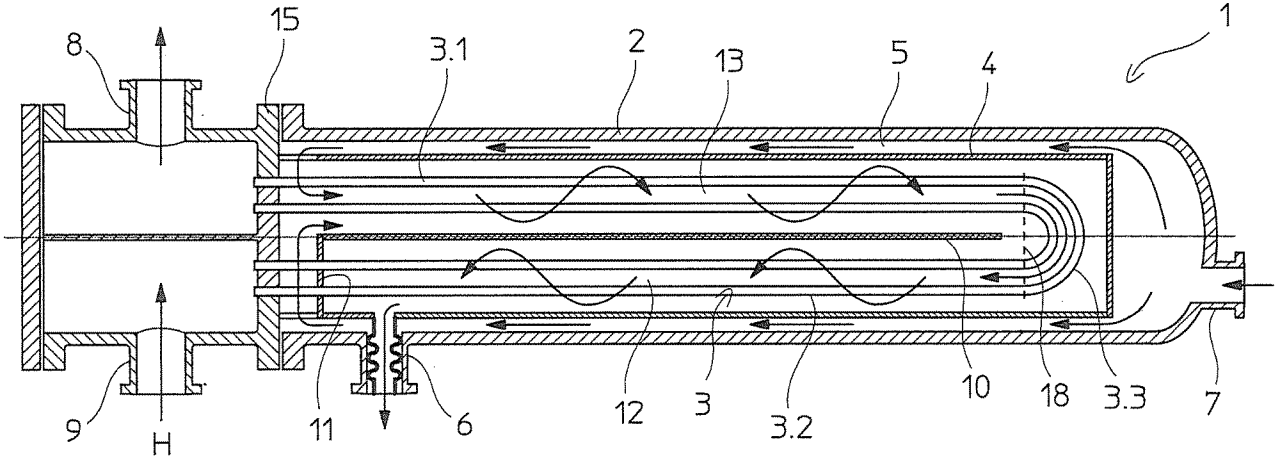

FIG. 2 shows an exchanger which is constructionally similar to that of FIG. 1, the components thereof being indicated by the same reference numbers. In the case of FIG. 2, the hot fluid H circulates in the tube side, entering via the interface 9 and exiting via the interface 8, and the cold fluid C circulates in the shell side entering via the interface 7 and exiting via the interface 6.

In this embodiment shown in FIG. 2, the cooling fluid C initially flows along the interspace 5 (with a flushing effect along the shell 2) and then flows, in this order, into the zones 13 and 12 of the shell side, i.e. inside the two passages defined by the baffles 10 and 11. The hot fluid entering via the interface 9 flows in sequence along the branches 3.2, 3.3 and 3.1 of the tubes. Also in FIG. 2, consequently, the heat exchange is always in a counter-current regime for both the passages of the shell side.

In both the examples of FIG. 1 and FIG. 2 a reduction in the temperature of the outer shell 2 and the tube plate 15 is obtained, owing to the flushing of the interspace 5, while benefiting from the exchange efficiency resulting from the pure counter-current condition.

Figure 3:
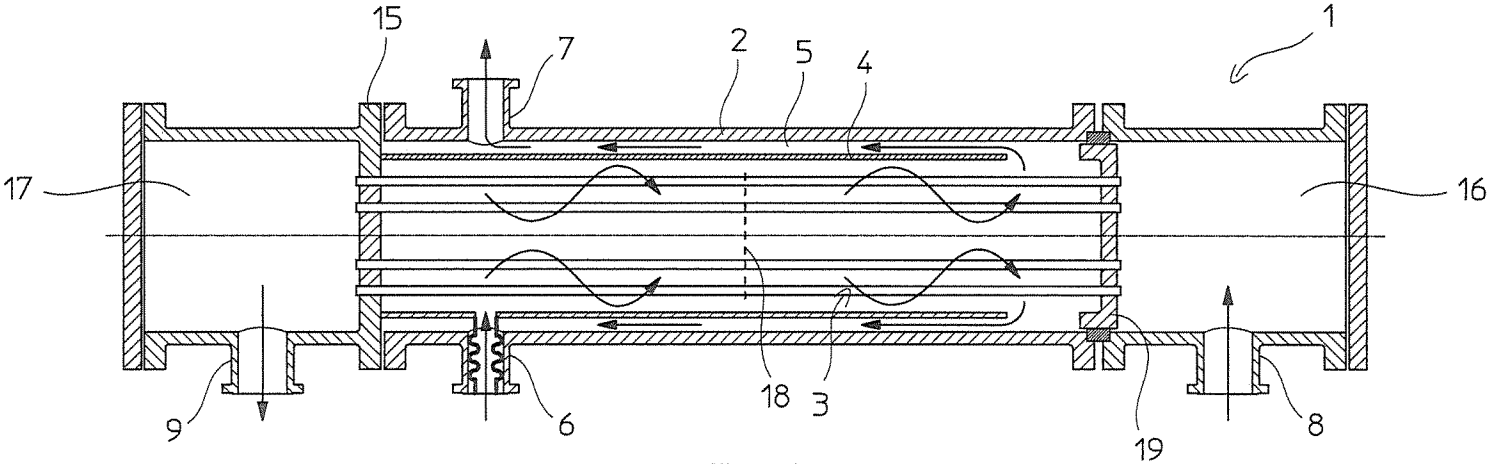
Figure 4:
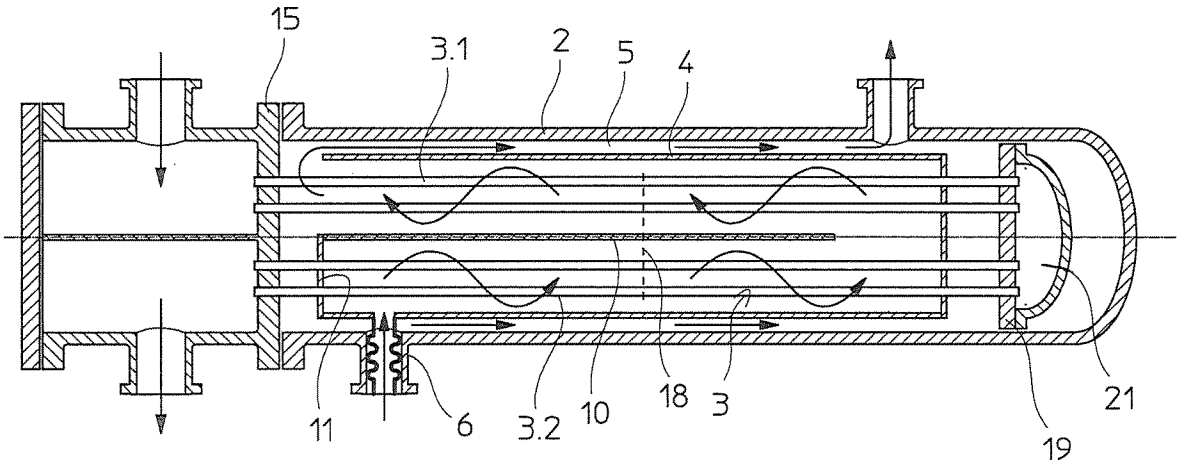

FIGS. 3 and 4 shows a floating-head heat exchanger, with hot fluid supplied in the shell side and straight tubes, respectively with one passage (FIG. 3) and two passages (FIG. 4) in the shell side.

For simplicity, the items similar to those in FIGS. 1 and 2 are indicated by the same reference numbers, in particular the outer shell 2, the tube bundle 3, the inner shell 4, the interspace 5.

In the embodiment shown in FIG. 3, the exchanger 1 comprises straight tubes having one end fixed to the tube plate 15 and the opposite end fixed to a floating head 19.

The hot fluid entering via the interface 6 flows along the shell side with a longitudinal flow path (as indicated by the arrows in FIG. 3) and then returns towards the outlet interface 7 passing into the flushing interface 5. The cold fluid passes through the tubes with a counterflow from the supply chamber 16 to the collection chamber 17.

In the embodiment shown in FIG. 4 the exchanger is also provided with baffles 10, which define two passages in the shell side. Consequently, in order to obtain the counter-current flow, the path in the tube side comprises an outgoing section in a first set of first tubes 3.1 and a return section in a second set of tubes 3.2 (equivalent to the branches of the U-shaped tubes of FIGS. 1-2), and the floating head 19 comprises a chamber 21 for reversing the flow of the tube-side fluid.

It should also be noted that the embodiments of FIGS. 3 and 4 have the following common features: heat exchanger always in counter-current; cooling of the shell 2 by means of the flow passing in the interspace 5.

FIGS. 5 and 6 relate to constructional examples of the tube bundle 3 and the shell 4.

FIG. 5 shows a tube bundle 3 according to one of the embodiments of the invention, wherein the shell 4 comprises a wall 30 with a stepped polygonal cross-section. Said wall 30 is structurally integral with the tubes of the tube bundle 3 and is removably fixed to the baffles 18 which are formed with bars 31 fixed to the wall 30. Other equivalent embodiments are however possible.

It can be understood that the shell 4 formed by means of the aforementioned polygonal wall 30 remains very close to the peripheral tubes of the bundle 3, following the arrangement thereof much better than a circular cross-section. Consequently, the potential by-pass space around the tube bundle 3 is reduced.

As is known, in floating-head exchangers a drawback consists in the radial dimensions of the floating head which results in the need for a greater distance of the peripheral tubes of the tube bundle 3 from the shell 4, thereby reducing the exchange efficiency thereof. With the solution proposed, this drawback is overcome.

The wall 30 may be formed by different longitudinal sections and/or by different portions which together surround the tube bundle 3. The longitudinal sections are connected by releasable joints.

FIG. 6 shows a constructional variant with a cylindrical shell 4 and suitable for a U-shaped tube bundle 3. In this variant the shell 4 is formed by half-shells 4.1 and 4.2 joined together by longitudinal flanges 32. Said flanges 32 form a longitudinal joint of the shell 4.

Said half-shells support the longitudinal partition 10 so as to obtain distribution of the shell side into two passages and the desired counterflow with respect to the tube-side flow, as for example visible in FIG. 1. The figure also shows the baffles 18 in another embodiment different from that of FIG. 5. In this embodiment the baffles 18 essentially comprise a frame fixed to the half-shells 4.1 or 4.2 and bars which define through-openings for the tubes, providing said tubes with an anti-vibration support.

Figure 7:
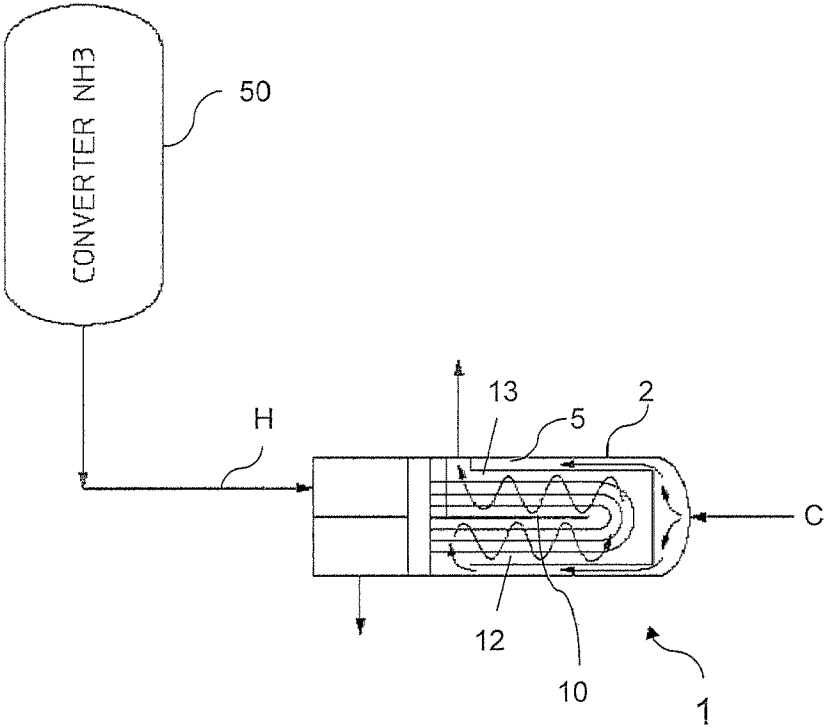
FIG. 7 shows a diagram of a plant according to the invention with the production of shell-side steam.

FIG. 7 shows an example of application of the exchanger shown in FIG. 1 to a plant with production of steam in the shell side. The hot fluid H flowing out of an ammonia reactor 50 circulates in the tube side, and the cooling fluid C circulates in the shell side. Said cooling fluid C flows initially through the interspace 5 and then passes into the zones 13 and 12 of the shell side, i.e. inside the two passages defined by the baffle 10, passing over the outer shell 2 and flowing out as steam.

Figure 8:
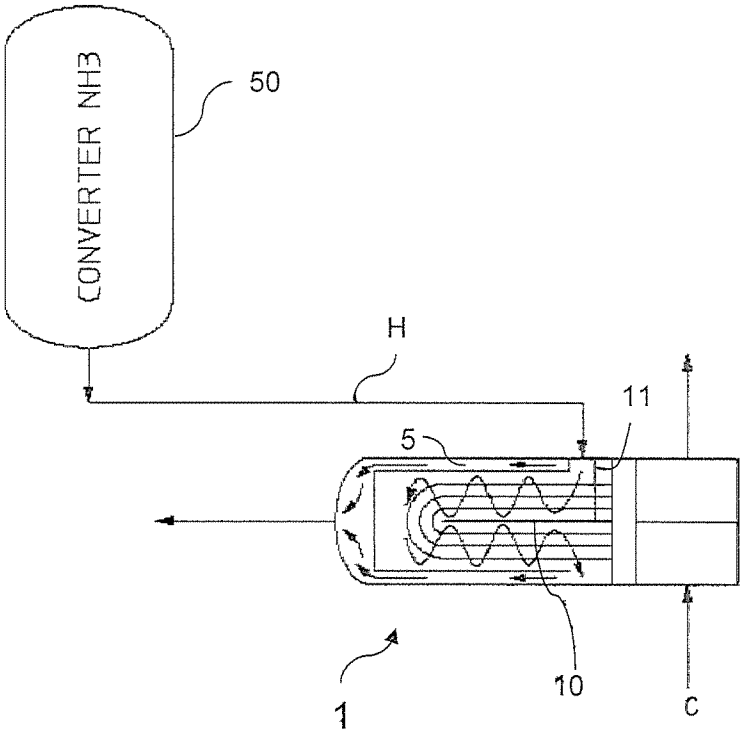
FIG. 8 shows a diagram of a plant according to the invention with the production of tube-side steam.

FIG. 8 shows a diagram of a plant similar to that of FIG. 5 in which the steam is produced in the tube side. The hot fluid H flows along two flow paths in the shell side, defined by the baffles 10 and 11, striking the tube bundle 3. Said fluid H is then conveyed in the interspace 5 between outer shell 2 and inner shell 4. The water flow instead flows along the tube side as shown in FIG. 6.

Figure 9:
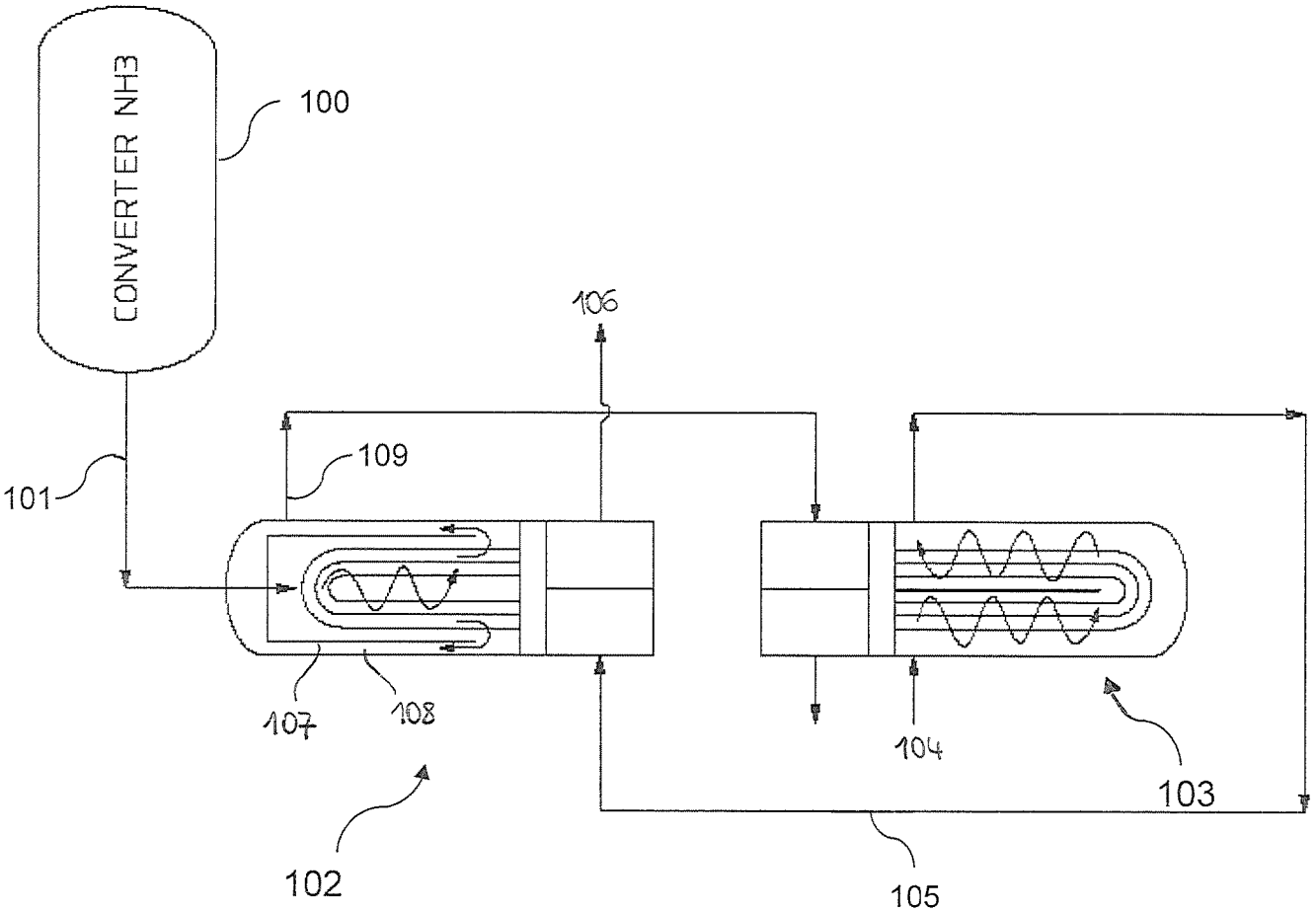
FIG. 9 (PRIOR ART)
FIG. 9 shows a diagram of a plant according to the prior art.

It can be noted that the heat available is conveniently recovered in a single apparatus 1, differently from the plant configuration according to the prior art shown in FIG. 9 where two apparatuses are used.

The invention claimed is:

1. A shell and tube heat exchanger comprising a first outer shell and a tube bundle, wherein said tube bundle defines a tube side of said exchanger, corresponding to the inside of the tubes of said bundle, and the exchanger comprises a shell side defined on the outside of said tube bundle, and said exchanger comprising inlet and outlet interfaces communicating with the shell side and with the tube side for a first fluid and for a second fluid respectively, wherein:

the exchanger comprises a second shell which is fully inside said first shell and which surrounds said tube bundle;

said second shell comprising at least one releasable longitudinal joint and comprising a plurality of longitudinal sections connected by releasable joints;

wherein said longitudinal sections are substantially parallel to an axis of said tube bundle;

wherein said second shell delimits said shell side of the exchanger, around said tube bundle, and further defines a flushing interspace which is delimited between said first shell and said second shell, said interspace communicating with said shell side, wherein said first fluid flows through said shell side with one or more longitudinal passages, and wherein said first fluid and said second fluid are in counter-current along said one or more longitudinal passages of the first fluid in the shell side, said tube bundle being structurally integral with said second shell, wherein said tube bundle comprises a plurality of baffles substantially perpendicular to an axis of said tube bundle, and said second shell is structurally cooperating with said baffles;

wherein said second shell rests on said baffles or is fixed to them.

2. The exchanger according to claim 1, comprising a system of baffles which defines a plurality of shell-side passages, around the tube bundle and inside said second shell, wherein consecutive passages have opposite directions of flow, and the first or the last of said passages directly communicates with said interspace.

3. The exchanger according to claim 2, wherein:

each of said shell-side passages is formed in a portion of the exchanger containing a respective subset of tubes of the tube bundle and/or respective portions of the said tubes, and the exchanger comprises means for distributing the second fluid in the tube side, which are arranged so that the tube-side flow in the subset of tubes or in the tube portions in a passage is always counter-current relative to the flow of the first fluid circulating in the shell side.

4. The exchanger according to claim 1, wherein: said system of baffles defines at least two passages in the shell side and, during the use, a hot fluid is supplied into the shell side, flows along said at least two passages, being cooled, and then flows along said flushing interspace.

5. The exchanger according to claim 1, wherein: said system of baffles defines at least two passages in the shell side and, during use, a cold fluid is supplied into the shell side, flows along said flushing interspace and then flows along said at least two passages of the shell side.

6. The exchanger according to claim 1, wherein said tube bundle is a bundle of U-shaped tubes.

7. The exchanger according to claim 1, wherein said tube bundle is a bundle of straight tubes with floating head.

8. The exchanger according to claim 1, wherein said second shell has at least one point for fastening to said tube bundle.

9. The exchanger according to claim 8, wherein said fastening point is chosen between a tube plate or at least one baffle of the said tube bundle.

10. The exchanger according to claim 1, wherein said second shell has a non-circular cross-section, preferably chosen among: a cross-section with a regular or irregular polygonal form; a stepped cross-section; a cross-section comprising at least one straight side and at least one curvilinear side, preferably in the form of a circle arc.

* * * * *